US006678213B1

(12) United States Patent
Rask et al.

(10) Patent No.: US 6,678,213 B1
(45) Date of Patent: Jan. 13, 2004

(54) SLOTTED CYLINDER TRANSDUCER WITH TRAPEZOIDAL CROSS-SECTIONAL ELECTRODES

(75) Inventors: Willard Rask, San Diego, CA (US); Jerome DeJaco, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 2 days.

(21) Appl. No.: 10/124,981

(22) Filed: Apr. 18, 2002

(51) Int. Cl.[7] ..... H01R 24/00
(52) U.S. Cl. ..... 367/163
(58) Field of Search ..... 367/157, 159, 367/162, 165, 163; 310/321, 322, 337, 369

(56) References Cited

U.S. PATENT DOCUMENTS

| | | | | |
|---|---|---|---|---|
| 4,220,887 | A | 9/1980 | Kompanek | |
| 4,651,044 | A | 3/1987 | Kompanek | |
| 4,682,070 | A | 7/1987 | Plambeck | |
| 4,774,427 | A | 9/1988 | Plambeck | |
| 5,020,035 | A | 5/1991 | Kompanek | |
| 5,122,992 | A | 6/1992 | Kompanek | |
| 5,267,223 | A | 11/1993 | Flanagan | |
| 6,002,648 | A | 12/1999 | Ambs | |
| 6,222,306 | B1 * | 4/2001 | Groult et al. | 310/337 |
| RE37,204 | E | 6/2001 | Kompanek | |
| 6,278,658 | B1 | 8/2001 | Skinner | |

OTHER PUBLICATIONS

Webster's Ninth New Collegiate Dictionary, 1985, p. 401.*

* cited by examiner

*Primary Examiner*—Daniel T. Pihulic
(74) *Attorney, Agent, or Firm*—Andrew J. Cameron; Michael A. Kagan; Peter A. Lipovsky

(57) ABSTRACT

A slotted cylinder transducer assembly, which has an outer cylindrical shell having a gap. A cylindrical actuator is disposed adjacent and inside the shell and has a gap which corresponds in position to the gap in the shell. The cylindrical actuator has a number of ceramic elements and electrodes alternately disposed circumferentially in the cylindrical actuator. Each of the ceramic elements are shaped in the form of a rectangular prism and have a rectangular cross-section. Each of the electrodes are shaped in the form of a trapezoidal prism and have a trapezoidal cross-section. The rectangular cross-section of the ceramic elements interposed together with the trapezoidal cross-section of the electrodes provides for the cylindrical shape of the actuator. The slotted cylinder transducer assembly may optionally include a seal boot, made preferably from a non-corrosive material for protecting from water or other material ingress.

11 Claims, 5 Drawing Sheets

SLOTTED CYLINDER TRANSDUCER WITH TRAPEZOIDAL CROSS-SECTIONAL ELECTRODES

Background of the Invention

The present invention relates to electromechanical transducers and more particularly relates to electromechanical transducers, which respond to electrical signals to produce mechanical vibrations at desired frequencies.

Electromechanical transducers can be employed as part of sonar devices, which are used to detect underwater objects. Such transducers may be either a projector or a receiver. A projector is a sonar transmitter which converts electrical signals to mechanical vibrations, while a receiver conversely intercepts acoustic vibrations and converts them into electrical signals. Projector and receiver arrays are formed from multiple projectors and receivers, which are then utilized typically in conjunction with a sea craft to detect underwater objects.

A projector comprises an electromechanical stack of ceramic elements that generate mechanical vibrations when an electrical signal is applied. Electrodes interposed between the ceramic elements are included for applying the electrical signal to the ceramic elements.

Many different types of sonar projectors are known. One type of projector is a flextensional transducer. In general, an electromechanical stack is housed within an elliptically shaped outer shell. Application of an electrical signal by the electrodes to the ceramic elements causes the electromechanical it stack to vibrate which, in turn, produces magnified vibrations of the outer shell. Thereafter, the vibrations generate acoustic waves in the water.

Another type of projector is commonly referred to as a slotted cylinder projector. The slotted cylinder projector includes a cylindrical actuator disposed inside an outer cylindrical shell. Both the cylindrical actuator and cylindrical outer shell include gaps that coincide in position with one another. When the cylindrical actuator receives an electrical signal(s), the cylindrical actuator and cylindrical outer shell vibrate at a desired frequency in a direction to decrease and increase the dimensions of the gap.

The cylindrical actuator of the slotted cylinder projector typically includes an electromechanical stack comprising ceramic elements interposed by electrodes. Present electromechanical stacks include ceramic elements with trapezoidal cross-sections and electrodes having rectangular cross-sections, so when interleaved together form the cylindrical shape of the typical slotted cylinder projector. The trapezoidal shape of the ceramic element is typically manufactured by machining a larger rectangular cross-sectioned ceramic plate. This added machining process makes trapezoidal ceramic elements and their respective electromechanical stacks expensive and time consuming to produce. Despite cost and significant time investment electromechanical stacks have been made in this manner for years. It can be appreciated that an inexpensive and timely-to-manufacture slotted cylinder projector is needed.

SUMMARY OF THE INVENTION

The present invention provides a slotted cylinder transducer assembly that addresses the problems mentioned previously. In one embodiment, the invention provides an improved slotted cylinder transducer assembly of the type, which has a cylindrical actuator having a gap and a cylindrical outer shell having a gap coinciding in position with the gap in the cylindrical actuator. The cylindrical actuator includes a plurality of ceramic elements and electrodes. The ceramic elements are disposed circumferentially and each of the electrodes are disposed adjacent to at least one of the ceramic elements. The improvement comprises the ceramic elements being shaped substantially in the form of a rectangular prism and the electrodes being shaped substantially in the form of a trapezoidal prism.

This invention provides a cylindrical actuator, which is easier and less expensive to manufacture. The electrodes used in the present invention are typically easier and cheaper to shape into the form of a trapezoidal prism than the previously mentioned ceramic plates.

The previously summarized features and advantages along with other aspects of the present invention will become clearer upon review of the following specification taken together with the included drawings.

DESCRIPTION OF THE EMBODIMENTS

Figure 1:
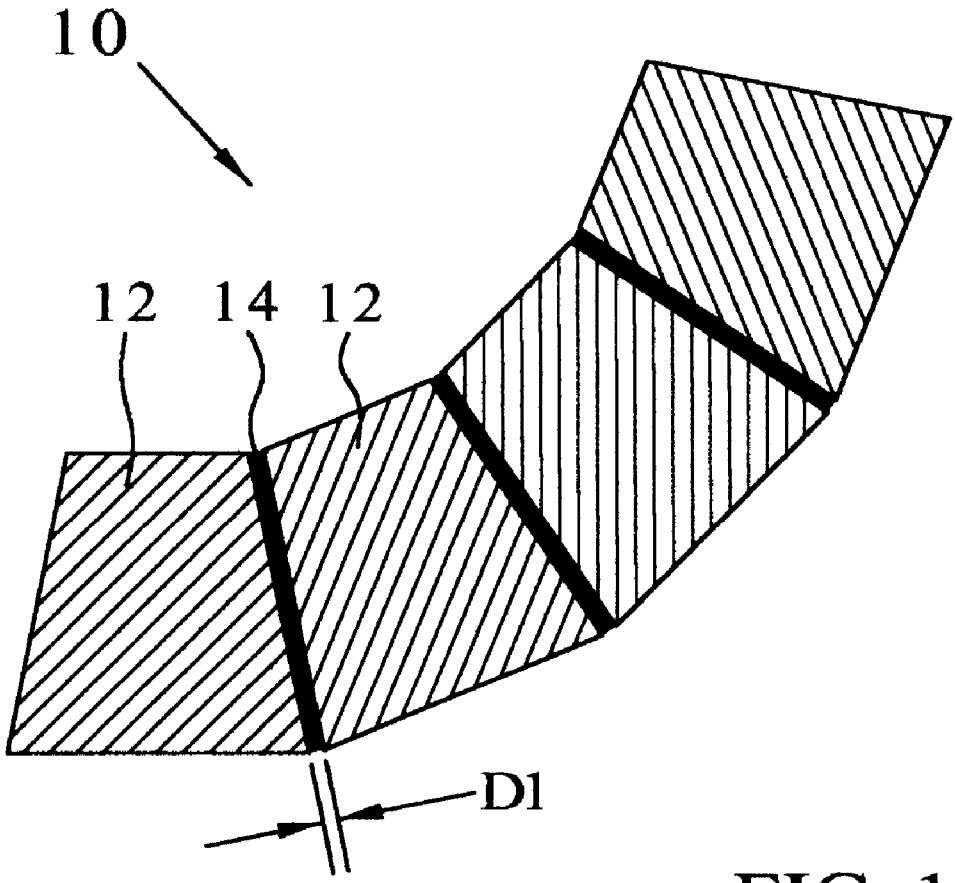
FIG. 1 (PRIOR ART)
FIG. 1 is a cross-sectional view of a PRIOR ART electromechanical stack, which has ceramic elements with trapezoidal cross-sections and electrodes with rectangular cross-sections.

FIG. 1 shows a cross-sectional view of a prior art electromechanical stack 10. Prior art electromechanical stack 10 includes a plurality of ceramic elements 12 and a plurality of electrodes 14. Electrodes 14 are each disposed adjacent to at least one of the ceramic elements 12 to arrange a circular formation, such as shown in FIG. 1. Presently, ceramic elements 12 are manufactured having a cross-section in the shape of a trapezoid, typically by machining a rectangular ceramic plate into a trapezoidal prism. Electrodes 14 are currently manufactured having a cross-section in the shape of a rectangle. Electrode width D1 is typically about 0.003 inches thick.

Figure 2:
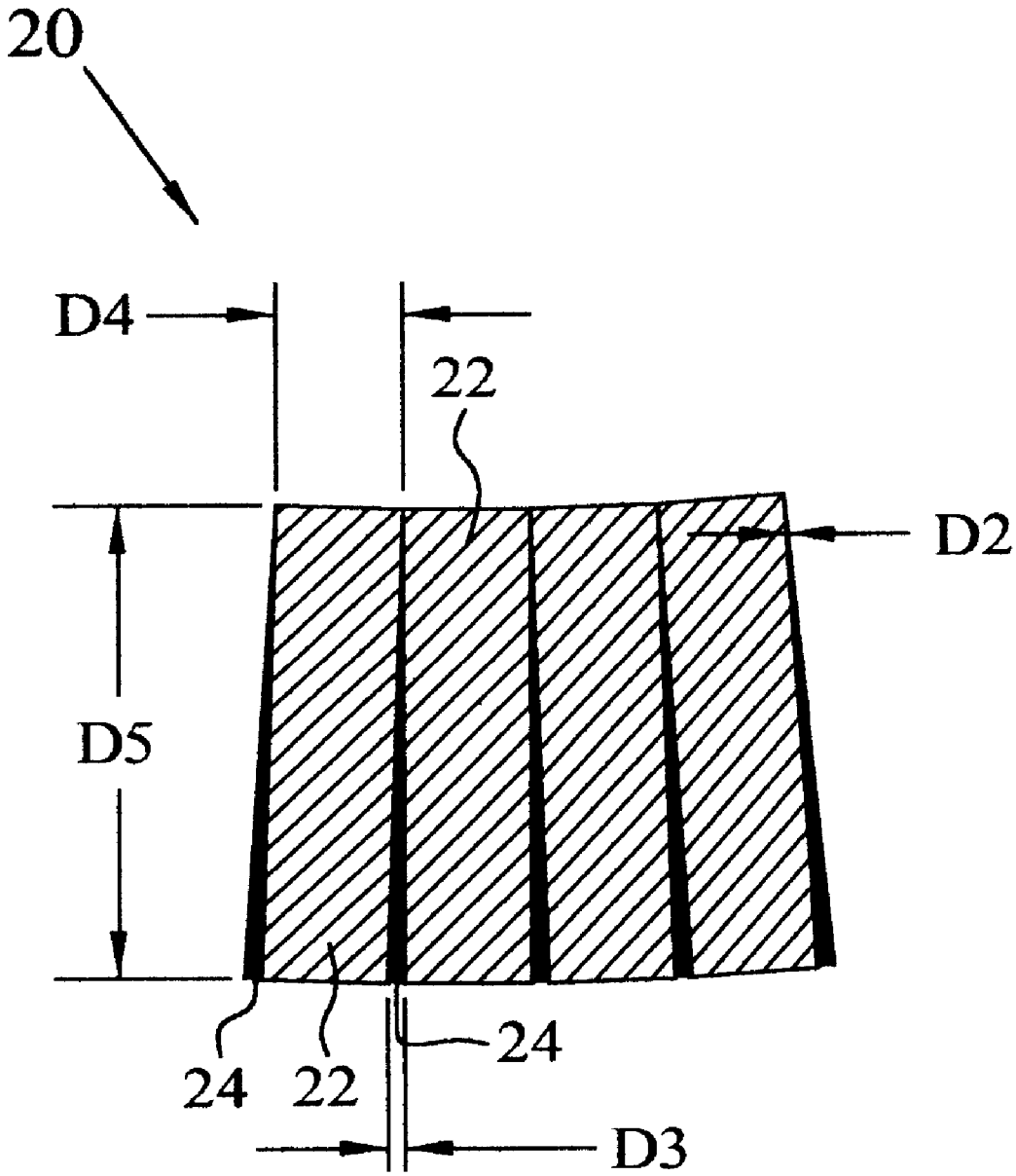
FIG. 2 is a cross-sectional view of an electromechanical stack in accordance with the present invention, which has ceramic elements with rectangular cross-sections and electrodes with trapezoidal cross-sections.

FIG. 2 is a cross-sectional view of an electromechanical stack 20 in accordance with the present invention. Electromechanical stack 20 includes a plurality of ceramic elements 22 and a plurality of electrodes 24. Ceramic elements 22 are formed having a rectangular cross-section and electrodes 24 are formed having a substantially trapezoidal cross-section. Electrodes 24 are each disposed adjacent to at least one of the ceramic elements 22 to arrange a circular formation, such as shown in FIG. 2. Although FIG. 2 only shows four ceramic elements 22 and five electrodes 24, it should be realized that any number of ceramic elements 22 and electrodes 24 may be used in the electromechanical stack 20.

Still referring to FIG. 2, electrodes 24 may be constructed to any size, so long as their cross-section is substantially trapezoidal in shape and when disposed adjacent to ceramic elements 22 together arrange a circular formation. Typically, electrodes 24 are made as thin as possible while still allowing for the circular formation described previously. Electrodes 24 have two substantially parallel sides, one of width D2 and one of width D3, and two non-parallel sides. By way of example, electrode 24 has one parallel side of width D3 that is about 0.050 inches, another parallel side of width D2 that is about 0.005 inches and a height D5 of 1.4 inches.

Figure 3:
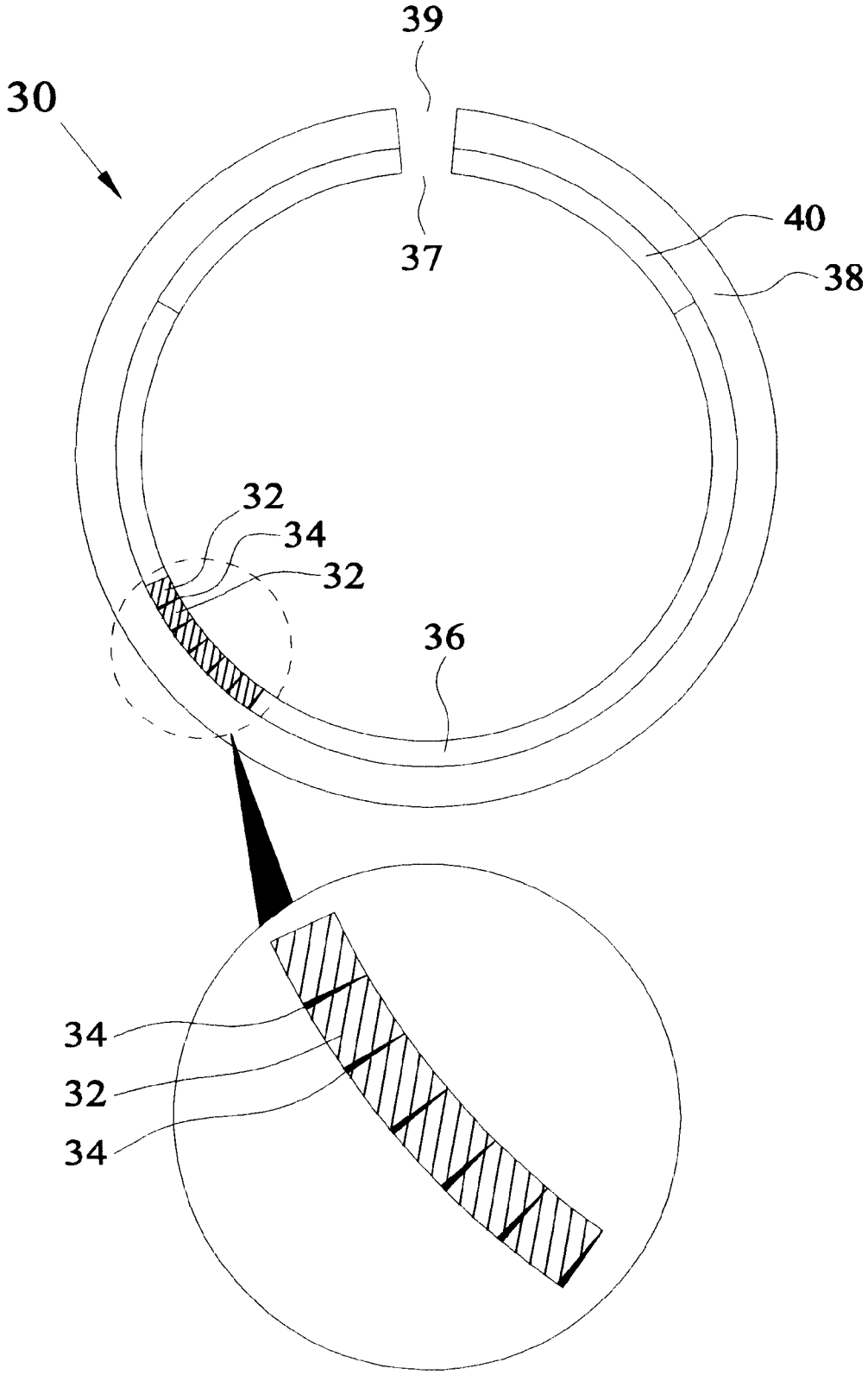
FIG. 3 is a cross sectional view of the slotted cylinder transducer assembly of FIG. 4.
Figure 4:
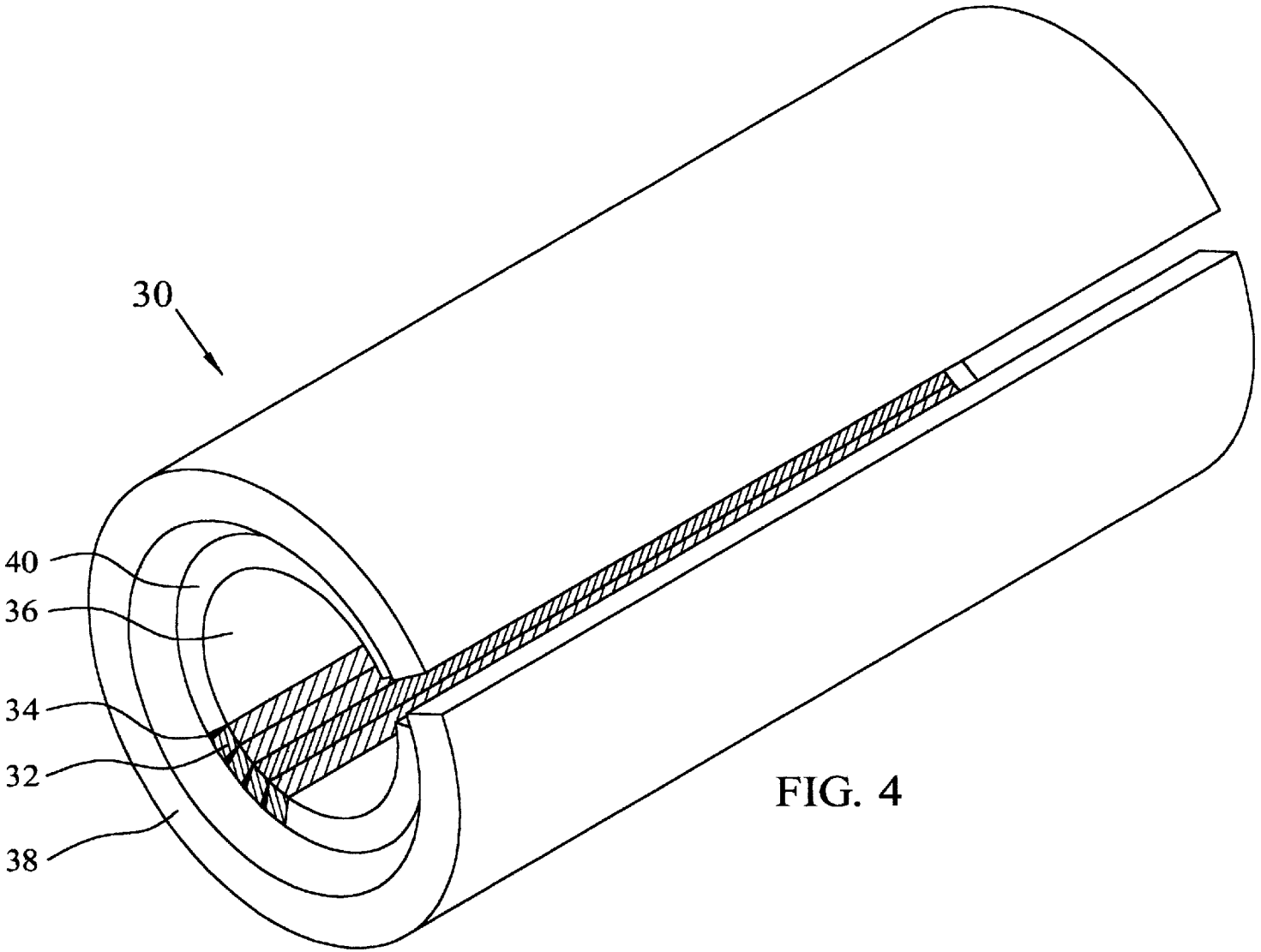
FIG. 4 is a perspective view of a slotted cylinder transducer assembly in accordance with the present invention.

FIGS. 3 and 4 show an improved slotted cylinder transducer assembly 30 in accordance with the present invention. Slotted cylinder transducer assembly 30 is of the type that includes an outer cylindrical shell 38. Outer cylindrical shell 38 may be made from a suitable material such as graphite epoxy composite. Outer cylindrical shell 38 includes a gap 39. Slotted cylinder transducer assembly 30 further includes a cylindrical actuator 36, which has a gap 37 that coincides in position with gap 39. Slotted cylinder transducer assembly 30 also includes a plurality of ceramic elements 32 disposed circumferentially and a plurality of electrodes 34 disposed adjacent to at least one of the ceramic elements 32. As shown in FIGS. 3 and 4 ceramic elements 32 have a rectangular cross-section and are in the shape of a rectangular prism. Also, electrodes 34 have a substantially trapezoidal cross-section and are substantially in the shape of a trapezoidal prism. Although FIGS. 3 and 4 show a fixed number of ceramic elements 32 and electrodes 34 it is noted that any number of ceramic elements 32 and electrodes 34 may be used so as to achieve the desired performance from slotted cylinder transducer assembly 30. Cylindrical actuator 36 optionally includes inactive material 40.

Figure 5:
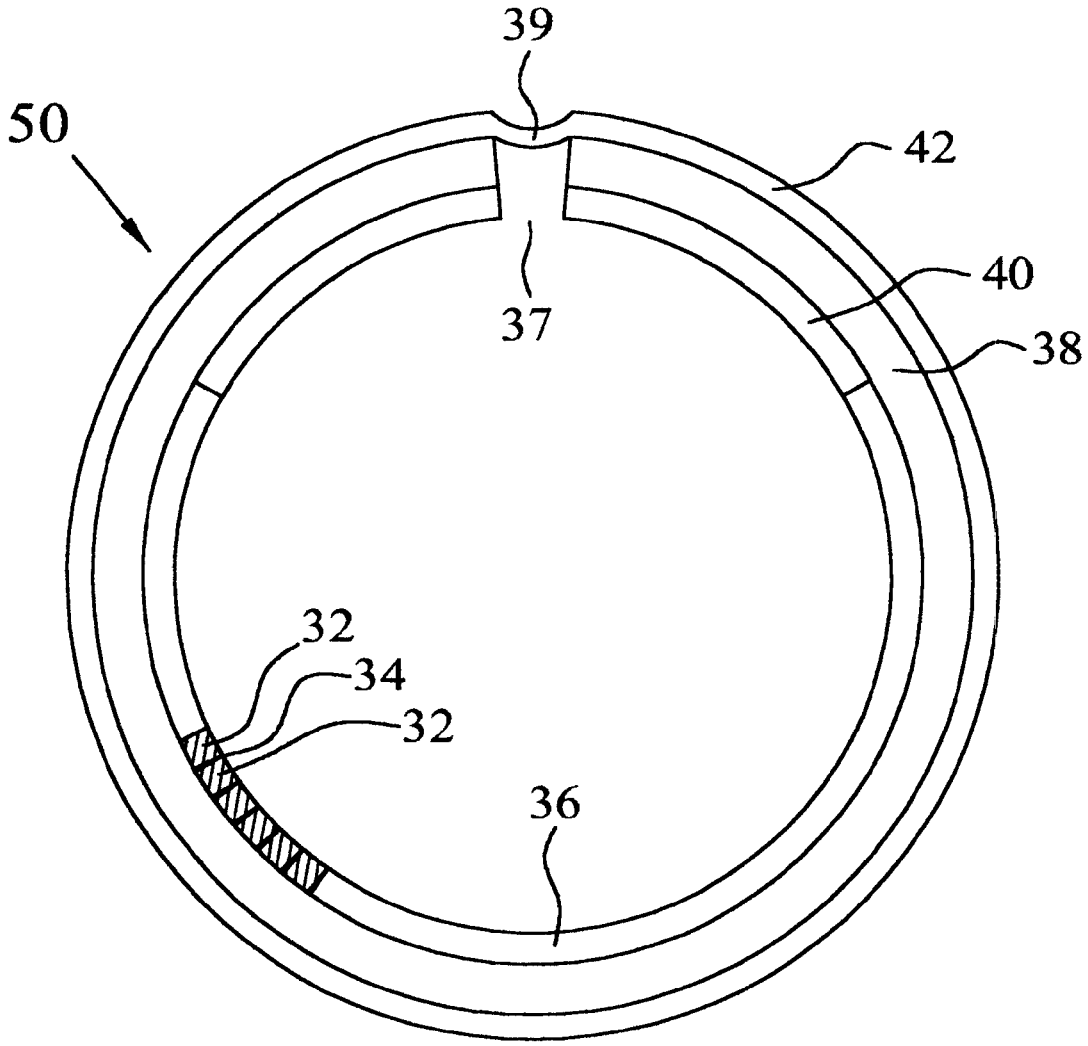
FIG. 5 is a cross sectional view of a second slotted cylinder transducer assembly in accordance with the present invention.

FIG. 5 shows slotted cylinder transducer assembly 50, in accordance with the present invention. Slotted cylinder transducer assembly 50 is similar in construction to slotted cylinder transducer assembly 30, described previously. It includes an optional seal boot 42 for protecting cylindrical actuator 36 and outer cylindrical shell 38. Seal boot 42 substantially encloses the entire outer cylindrical shell 38 and cylindrical actuator 36 to prevent water or other substances from ingressing into the slotted cylinder assembly 50. By way of example, seal boot 42 is made from a neoprene rubber material.

All ceramic elements described herein are made from a material that generates mechanical strain when an electrical signal is applied. Preferably, the ceramic elements are made from a piezoelectric material, but may alternatively comprise an electrostrictive material.

All electrodes described herein are made from a highly conductive material for applying the electrical signal to the ceramic elements. For example, the electrodes described previously may be made from one or more copper selected from the group, but not limited to: copper C26000, copper C11000, copper C10100, copper C10200, and copper C17200.

We claim:

1. An improved slotted cylinder transducer assembly including an outer cylindrical shell having a gap and a cylindrical actuator adjacent to said outer cylindrical shell, said cylindrical actuator having a gap substantially coinciding in position with said gap in said outer cylindrical shell and said cylindrical actuator having an a plurality of ceramic elements and a plurality of electrodes, said ceramic elements disposed circumferentially and each of said electrodes disposed adjacent to at least one of said ceramic elements, wherein the improvement comprises:

(a) each of said ceramic elements being shaped substantially in the form of a rectangular prism; and (b) each of said electrodes being shaped substantially in the form of a trapezoidal prism.

2. An electromechanical stack for use in a cylindrical transducer assembly, said electromechanical stack comprising:

a plurality of ceramic elements circumferentially disposed with respect to one another, each shaped having a substantially rectangular cross-section, said ceramic elements for generating mechanical vibrations when an electrical signal is applied; and a plurality of electrodes circumferentially disposed and each adjacent to at least one of said ceramic elements, each of said electrodes shaped having a substantially trapezoidal cross-section, said electrodes for applying said electrical signal to said ceramic elements;

wherein said substantially trapezoidal cross-section of each said electrode comprises a first, second, third, and fourth side, said first side being substantially parallel to said second side and said third side being non-parallel to said fourth side; and wherein said first side has a length less than about 0.005 inches.

3. The electromechanical stack as in claim 2 wherein:

said second side has a length less than about 0.050 inches.

4. The electromechanical stack as in claim 2 wherein said ceramic elements comprise piezoelectric material.

5. The electromechanical stack as in claim 2 wherein said ceramic elements comprise electrostrictive material.

6. The electromechanical stack as in claim 2 wherein said electrodes comprise a conductive material.

7. The electromechanical stack as in claim 6 wherein said conductive material is selected from the group consisting of copper C26000, copper C11000, copper C10100, copper C10200, and copper C17200.

8. A slotted cylinder transducer assembly comprising:

(a) an outer cylindrical shell having a gap;

(b) a cylindrical actuator adjacent to said outer cylindrical shell, said cylindrical actuator having a gap substantially coinciding in position with said gap in said outer cylindrical shell; and (c) said cylindrical actuator comprising:

(i) a plurality of ceramic elements shaped substantially in the form of a rectangular prism and disposed circumferentially on said cylindrical actuator, said ceramic elements for generating mechanical vibrations when an electrical signal is applied; and (ii) a plurality of electrodes shaped substantially in the form of a trapezoidal prism and disposed circumferentially and each adjacent to at least one of said ceramic elements, said electrodes for applying said electrical signal to said ceramic elements.

9. The slotted cylinder transducer assembly as in claim 8 further comprising a seal boot attached to the outside of said outer shell and substantially enclosing said outer shell.

10. The slotted cylinder transducer assembly as in claim 9 wherein said seal boot is made from a substantially non-corrosive material.

11. The slotted cylinder transducer assembly as in claim 8 wherein said gaps in said outer cylindrical shell and said cylindrical actuator extend only partially along the lengths of said outer cylindrical shell and said cylindrical actuator for adjusting the frequency characteristics of said cylindrical transducer assembly.

* * * * *